United States Patent [19]

Halm

[11] 4,160,667

[45] Jul. 10, 1979

[54] ALUMINUM CHELATES AS ACCEPTOR TYPE SENSITIZERS AND PLASTICIZERS FOR PHOTOCONDUCTIVE POLYMERS

[75] Inventor: James M. Halm, Lombard, Ill.

[73] Assignee: AM International, Inc., Los Angeles, Calif.

[21] Appl. No.: 808,858

[22] Filed: Jun. 22, 1977

[51] Int. Cl.[2] ..... G03G 5/09; G03G 5/04

[52] U.S. Cl. ..... 96/1.5 R; 260/340.6; 96/1.6

[58] Field of Search ..... 96/1.5 R, 1.6

[56] References Cited

U.S. PATENT DOCUMENTS 3,840,368 10/1974 Ikeda et al. ..... 96/1.6 X

*Primary Examiner*—Roland E. Martin, Jr.

*Attorney, Agent, or Firm*—Michael A. Kondzella; George Jameson; Robert S. Hulse

[57] ABSTRACT

A series of chelated diketones in which the chelated atom is aluminum can be used as acceptor type sensitizers and plasticizers for polymeric photoconductors of the donor type used in electrophotography.

9 Claims, No Drawings

ALUMINUM CHELATES AS ACCEPTOR TYPE SENSITIZERS AND PLASTICIZERS FOR PHOTOCONDUCTIVE POLYMERS

BACKGROUND OF THE INVENTION

This invention relates to sensitizers for use in electrophotography. In one of its more particular aspects this invention relates to the use of a class of chelated diketones as acceptor type sensitizers and plasticizers for polymeric photoconductors of the donor type in an electrophotographic process.

SUMMARY OF THE INVENTION

The sensitizers of this invention have the formula:

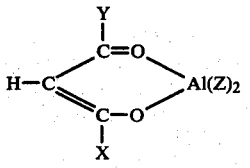

where X, Y and Z can be alkyl, aryl or an electron withdrawing group and can be the same or different.

These materials, which are chelate derivatives of 1,3-diketones have been observed to increase the sensitivity to electromagnetic radiation in the visible portion of the spectrum and to serve as plasticizers for photoconductors of the donor type.

DESCRIPTION OF THE PREFERRED EMBODIMENTS

The sensitizers of this invention may be incorporated with organic photoconductive polymers of the donor type, of which a wide variety are known. These include polystyrenes, polyvinylxylenes, polyvinylnaphthalenes, poly-4-vinyl biphenyl, poly-9-vinylanthracene, poly-3-vinylpyrene, poly-2-vinylquinoline, polyacenaphthalene, polyindene, polycarbonates and polyvinylcarbazole and derivatives thereof. The latter form a preferred subgroup of photoconductive polymers and will be exemplified herein.

Poly-N-vinylcarbazole, for example, is available under the trademark Luvican sold by Badische Anilin und Sodafabrik A. G., Ludwigshafen, Germany. This polymer can have a molecular weight which may vary over a wide range of about 20,000–5,000,000. The preferred molecular weight range for electrophotographic applications is from about 200,000 to 2,000,000.

The poly-N-vinylcarbazole (PVK) is dissolved in a suitable solvent such as chlorobenzene and the sensitizer added.

The sensitizer is used in an amount expressed as moles of sensitizer per 100 moles of polymer. In the case of PVK the molecular weight is taken on the basis of the molecular weight of the N-vinylcarbazole monomer which is 193.1. The preferred range is from about 1 mole to 35 moles.

Other photoconductive polymers in the preferred subgroup include the polyvinylbenzocarbazoles described in U.S. Pat. No. 3,751,246 to Helen C. Printy and Evan S. Baltazzi and the polyvinyliodobenzocarbazoles described in U.S. Pat. No. 3,764,316 to Earl E. Dailey, Jerry Barton, Ralph L. Minnis and Evan S. Baltazzi.

The sensitizers of this invention include a large number of compounds as defined by means of the structural formula given above. The following is a partial list of such sensitizers:

- difluoroaluminum-1,3-diphenyl-1,3-propanedionate
- difluoroaluminum-1-phenyl-3-methyl-1,3-propanedionate
- difluoroaluminum-1,3-dimethyl-1,3-propanedionate
- difluoroaluminum-1,3-bis(4-fluorophenyl)-1,3-propanedionate
- difluoroaluminum-1,3-bis(4-methoxyphenyl)-1,3-propanedionate
- difluoroaluminum-1,3-bis(4-trifluoromethylphenyl)-1,3-propanedionate
- difluoroaluminum-1-(4-fluororphenyl)-3-(4-methoxyphenyl)-1,3-propanedionate
- difluoroaluminum-1-trifluoromethyl-b 3-(2-thenyl)-1,3-propanedionate
- diphenylaluminum-1,3-diphenyl-1,3-propanedionate
- diphenylaluminum-1-phenyl-3-methyl-1,3-propanedionate
- diphenylaluminum-1,3-bis(4-fluorophenyl)-1,3-propanedionate
- diphenylaluminum-1,3-bis(4-trifluoromethylphenyl)-1,3-propanedionate
- diphenylaluminum-1-trifluoromethyl-3-(2-thenyl)-1,3-propanedionate
- diphenylboron-1-trifluoromethyl-3-(2-thenyl)-1,3-propanedionate.

The chelate sensitizers of this invention have been found to improve the photoresponse of photoconductors with which they are incorporated. Organic photoconductors are known to have a rather slow response to electromagnetic radiation in the visible range, being more sensitive to ultraviolet radiation.

In electrophotographic reproduction an electrostatic charge is applied to the photoconductor which is imaged by exposing to a pattern of light and shadow comprising electromagnetic radiation in the visible range to produce a latent electrostatic image. A developed material image is produced by the application of electroscopic powder to the latent image.

Use of the sensitizer of this invention enables the use of conventional incandescent lamps as sources of illumination in electrophotographic reproduction equipment.

A donor-acceptor charge transfer complex is formed upon combination of organic photoconductors with the sensitizers of this invention.

The improvement in photoresponse of the photoconductor depends to a large extent upon the solubility of the charge transfer complex in the solvent system employed. A wide range of solvents and solvent blends may be used depending on the particular polymer with which the sensitizer combines to form the complex. Exemplary of such solvents are toluene, acetone, methyl ethyl ketone, acetyl acetone, acetyl chloride, amyl acetate, amyl formate, benzaldehyde, butyl acetate, butyl bromide, butyl methacrylate, butyl Cellosolve, butyl stearate, butyrolactone, Cellosolve, cyclohexanone, diacetone alcohol, butyl ether, diethyl ether, dimethyl ether, dioxane, ethyl benzoate, ethyl chloride, ethylene oxide, furan, hexanediol and methyl Cellosolve. Preferred solvents are cyclohexane and tetrahydrofuran.

The sensitizer and photoconductor may be both added to the solvent or each may be dissolved or dispersed separately and then combined.

Since the photoconductors sensitized in accordance with this invention are polymeric photoconductors, the sensitized photoconductor can be applied in the form of a polymeric film to a conductive base support in order to provide an electrophotographic recording element.

The film is applied in the form of a uniform continuous layer by conventional coating means such as a wire-wound rod, a trailing blade coater or a menisous coater at the rate of about 0.5 gram to 4.0 grams per square foot, preferably 0.75 gram to 1.0 gram, to produce a film thickness in the range of about 2 microns to 75 microns, preferably in the range of 25 microns to 35 microns. The coating is passed through a drying oven in order to force evaporate excess solvent.

The invention will be better understood by reference to the following examples which are intended to illustrate but not to unnecessarily limit the scope of this invention which is defined in the claims appended hereto.

EXAMPLE 1

Dichloroaluminum-1,3-diphenyl-1,3-propanedionate, 0.2 mole fraction and polyvinyliodobenzocarbazole (PVIBK) were mixed in freshly distilled cyclohexanone/tetrahydrofuran (60/40) in a concentration of 5–6% solids. The resulting mixture was stirred in a capped bottle for 8 hours to achieve solubility and then filtered through a pressure filter. The filtrate was coated on opaque aluminized Mylar to a film thickness of 4.0 microns using a meniscus coater with adjustable rheostat control of coating speed. The coating was transparent and almost colorless and displayed the properties of improved crease resistance, improved flake resistance and better adhesion to the Mylar substrate.

The resulting coated Mylar film was dark adapted for 24 hours. After electrostatic charging and subsequent light exposure, measurements were made with an electrostatic voltmeter coupled to a Gould recorder. The charge acceptance, CA; photographic speed, $I_{0.3}$; and $E_o$ were measured and found to be greatly improved over those of the unsensitized PVIBK. The results are shown in Table 1.

TABLE 1

| | CA v/μ | $I_{0.3}$ J/cm$^2$ | $E_0$ v/μ |
|---|---|---|---|
| Positive mode | +160 | 200 | 155 |
| Negative mode | −160 | >200 | 150 |

In addition the resolution, R, in line pairs per millimeter obtained at 5 seconds of exposure to 49 micro-watts of daylight fluorescent light and the photopic transmission, T, measured as percent transmission vs. a Mylar blank taken as 100% were determined. These results are shown in Table 2.

TABLE 2

| R lp/mm | T |
|---|---|
| 60 | 98 |

Similar results were obtained using polyvinylbenzocarbazole, polyvinylcarbazole, a copolymer of n-butyl acrylate and N-vinylcarbazole and polyvinyl-n-octylbenzocarbazole instead of the polyvinyliodobenzocarbazole exemplified above.

The invention has been described with respect to a limited number of specific embodiments. However, it is intended that alternative compositions and methods can be used and it is to be understood that this invention is not to be limited except in accordance with the following claims.

I claim:

1. An electrophotographic recording element comprising a conductive base support coated with a layer comprising an organic photoconductive polymer of the electron donor type and a sensitizer of the formula:

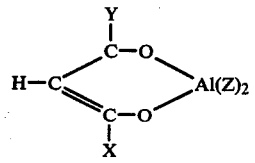

where X and Y each independently is a member selected from the group consisting of alkyl, aryl, electron withdrawing alkyl and electron withdrawing aryl and Z is a member selected from the group consisting of fluoro and phenyl.

2. An element according to claim 1 wherein the amount of sensitizer ranges from 0.1 mole to 100 moles per 100 moles of polymer, the molecular weight of said polymer being taken as the weight of the monomer.

3. An element according to claim 1 wherein the polymer is polyvinyliodobenzocarbazole.

4. An element according to claim 1 wherein the polymer is polyvinylbenzocarbazole.

5. An element according to claim 1 wherein the polymer is polyvinylcarbazole.

6. An element according to claim 1 wherein the polymer is a copolymer of n-butyl acrylate and N-vinylcarbazole.

7. An element according to claim 1 wherein the polymer is polyvinyl-n-octylbenzocarbazole.

8. An element according to claim 1 wherein the sensitizer is

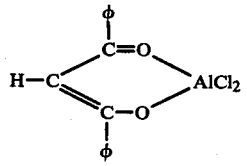

where $\phi$ is phenyl.

9. A method of making a reproduction comprising the steps of applying a sensitizing charge to an organic photoconductive polymer of the electron donor type sensitized with a compound of the formula:

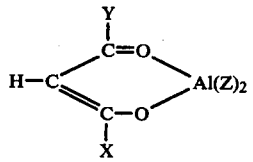

where X, Y and Z each independently is a member selected from the group consisting of alkyl, aryl and electron withdrawing groups, said compound being present in an amount ranging from 0.1 mole to 100 moles per 100 moles of polymer, the molecular weight of said polymer being taken as the weight of the monomer;

exposing the charged polymer to a pattern of light and shadow comprising electromagnetic radiation in the visible range to produce a latent image thereon; and applying electroscopic powder to produce a material image corresponding to said pattern of light and shadow.

* * * * *